US009267308B2

(12) United States Patent
Kojima

(10) Patent No.: US 9,267,308 B2
(45) Date of Patent: Feb. 23, 2016

(54) TENT

(71) Applicant: Masaaki Kojima, Higashiomi (JP)

(72) Inventor: Masaaki Kojima, Higashiomi (JP)

(73) Assignee: Masaaki Kojima, Shiga (JP)

( * ) Notice: Subject to any disclaimer, the term of this patent is extended or adjusted under 35 U.S.C. 154(b) by 33 days.

(21) Appl. No.: 14/196,084

(22) Filed: Mar. 4, 2014

(65) Prior Publication Data

US 2015/0252584 A1 Sep. 10, 2015

(51) Int. Cl.
*E04H 15/18* (2006.01)
*E04B 1/32* (2006.01)

(52) U.S. Cl.
CPC . *E04H 15/18* (2013.01); *E04B 1/32* (2013.01)

(58) Field of Classification Search
CPC ..... E04B 1/3211; E04B 1/32; E04B 7/10; A01G 9/02; E04H 15/18; E04H 15/54; E04H 1/00; E04H 1/02
USPC ..... 135/87, 97, 124, 136, 157–158, 135/904–906; 52/79.2–79.3, 80.1, 80.2, 52/81.1; 47/65.9, 66.5, 82–83; 405/285, 405/288, 293, 297, 302.1
See application file for complete search history.

(56) References Cited

U.S. PATENT DOCUMENTS

| | | | | |
|---|---|---|---|---|
| 2,651,143 | A * | 9/1953 | Esmay et al. | 47/33 |
| 2,837,866 | A * | 6/1958 | Esmay et al. | 47/33 |
| 3,448,748 | A * | 6/1969 | Walrave | 135/127 |
| 3,768,218 | A * | 10/1973 | Blaski | 52/81.5 |
| 5,097,640 | A * | 3/1992 | Skolnick et al. | 52/81.3 |
| 5,863,451 | A * | 1/1999 | Buhler | 249/13 |
| 6,421,963 | B1 * | 7/2002 | Pratola | 52/81.1 |
| 8,752,336 | B1 * | 6/2014 | Ozsuer | 52/2.15 |
| 2003/0145530 | A1 * | 8/2003 | James | 52/86 |

FOREIGN PATENT DOCUMENTS

JP 08-199859 A 8/1996

* cited by examiner

*Primary Examiner* — Winnie Yip
(74) *Attorney, Agent, or Firm* — Keating & Bennett, LLP

(57) ABSTRACT

A tent includes: a tent main body portion that has an internal space forming sheet member that is able to form an internal space; and a snow filling portion that is provided around an outer circumferential surface of the internal space forming sheet member and in which snow is allowed to be filled, wherein the snow filling portion has a plurality of cells arranged adjacently to one another in a circumferential direction of the snow filling portion, and each of the cells is open at a top and a bottom of the cell.

4 Claims, 6 Drawing Sheets

TENT

BACKGROUND OF THE INVENTION

1. Field of the Invention

The present invention relates to a tent, and in particular, to a tent suitably used in a snowy area.

2. Description of the Related Art

Among various tents, some are proposed as tents suitable for use in a snowy area or the like. For example, Japanese Patent Application Laid-open No. H08-199859 describes a tent including a frame tube into which a frame for installation of the tent is inserted and which is sewn to a sheet member (tent main body) of the tent so that the frame tube has a triangular cross section. The tent includes the frame tube in order to prevent the tent from being twisted and to improve durability against the external pressure of accumulated snow, a strong wind, and the like.

However, for the conventional tents including the tent shown in Japanese Patent Application Laid-open No. H08-199859, snow, along with a strong wind, is considered only to be an external pressure. Thus, the conventional techniques have dealt with the external pressure by improving the durability of the tent against the external pressure. With a view to positively utilize snow instead of relying on the conventional method for dealing with the external pressure, the present inventor has developed the present invention.

With the foregoing in view, it is an object of the present invention to provide a tent that is suitably used in a snowy area by positively utilizing snow, enhanced in its durability against the load of accumulated snow and enhanced in its ability to retain heat inside the tent.

SUMMARY OF THE INVENTION

To accomplish the object, a tent according to a preferred embodiment of the present invention includes: a tent main body portion that has an internal space forming sheet member that is able to form an internal space; and a snow filling portion that is provided around an outer circumferential surface of the internal space forming sheet member and in which snow is allowed to be filled, wherein the snow filling portion has a plurality of cells arranged adjacently to one another in a circumferential direction of the snow filling portion, and each of the cells is open at a top and a bottom of the cell.

Preferably, a plurality of the snow filling portions are formed in a vertical direction.

Preferably, each of the cells in the snow filling portion has an outer circumferential wall sheet member forming an outer circumferential wall and a partition wall sheet member extending from the outer circumferential sheet member toward the inside of the tent.

More preferably, in each of the cells adjacent to one another in the vertical direction, the partition wall sheet member of the lower cell is separate from the partition wall sheet member of the upper cell.

Still more preferably, when the cells adjacent to each other in the vertical direction are positioned so as to maximize a diameter of the outer circumferential wall sheet member of each of the cells, the outer circumferential wall sheet member of the lower cell has a larger diameter than the outer circumferential wall sheet member of the upper cell.

The tent according to the present invention, by positively utilizing snow, can be enhanced in its durability against the load of accumulated snow and can be enhanced in its ability to retain heat inside the tent.

DETAILED DESCRIPTION OF THE PREFERRED EMBODIMENT

Figure 1:
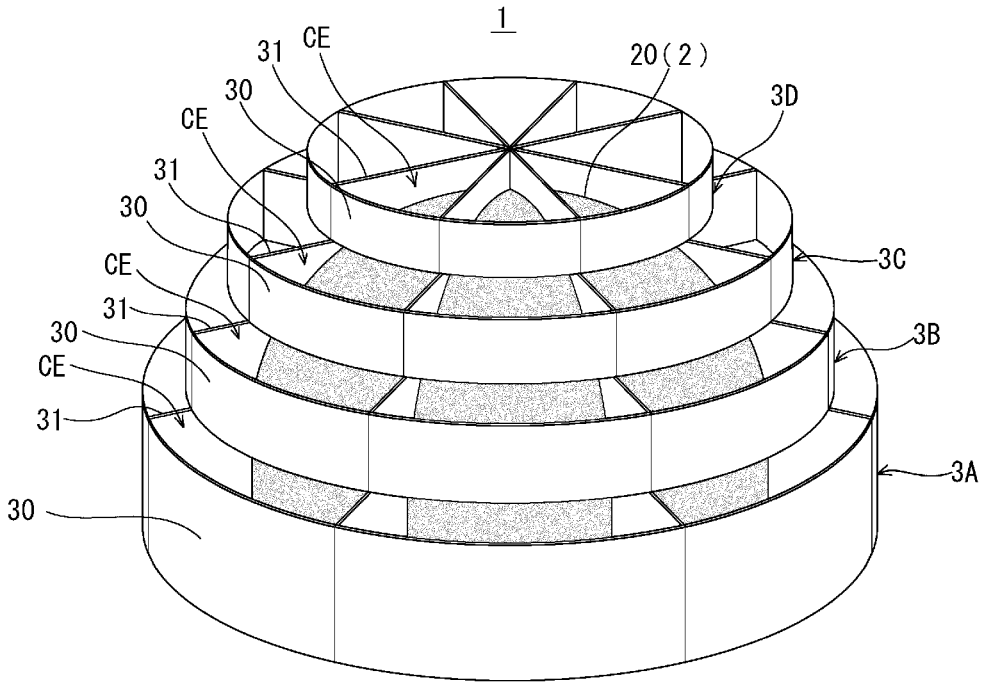
FIG. 1 is a perspective view showing the appearance of a tent according to an embodiment of the present invention.
Figure 2:
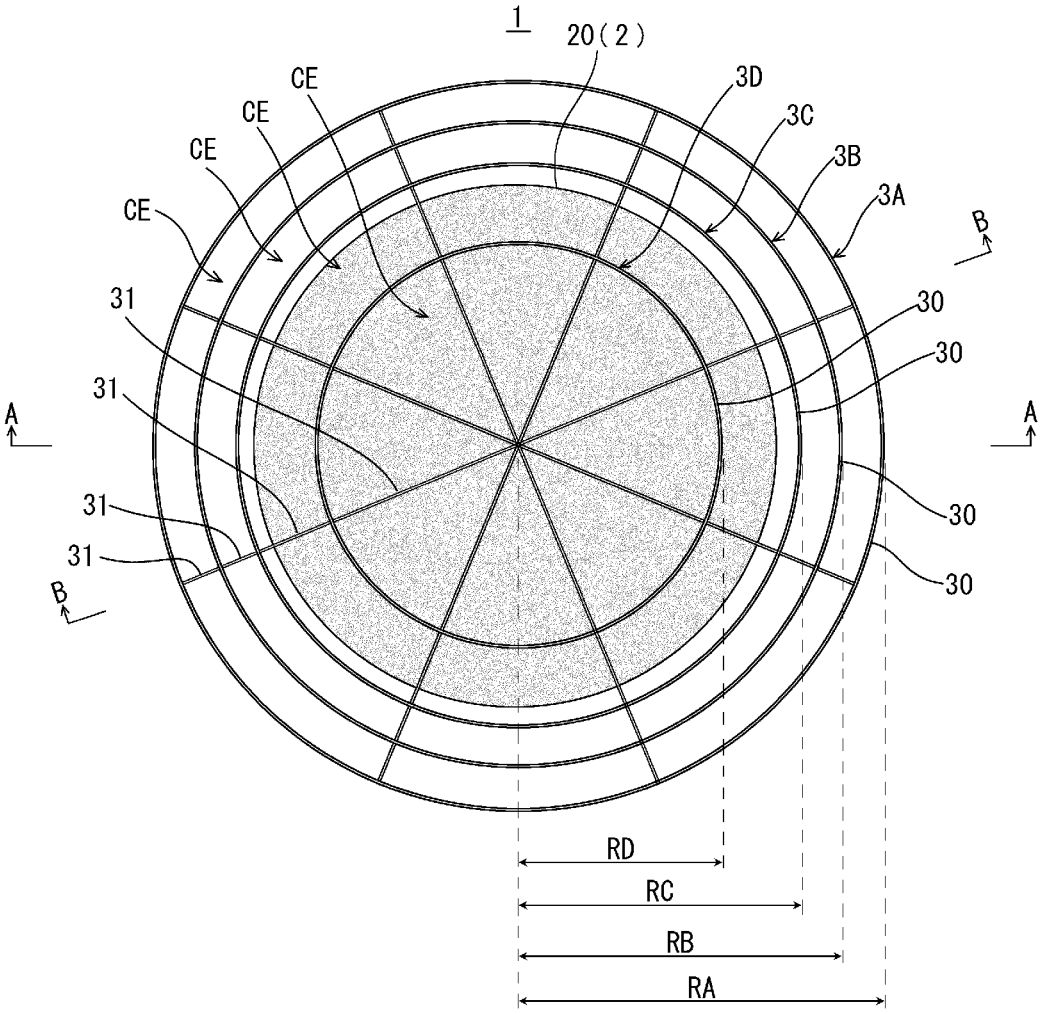
FIG. 2 is a plan view of the tent according to the embodiment of the present invention.
Figure 3:
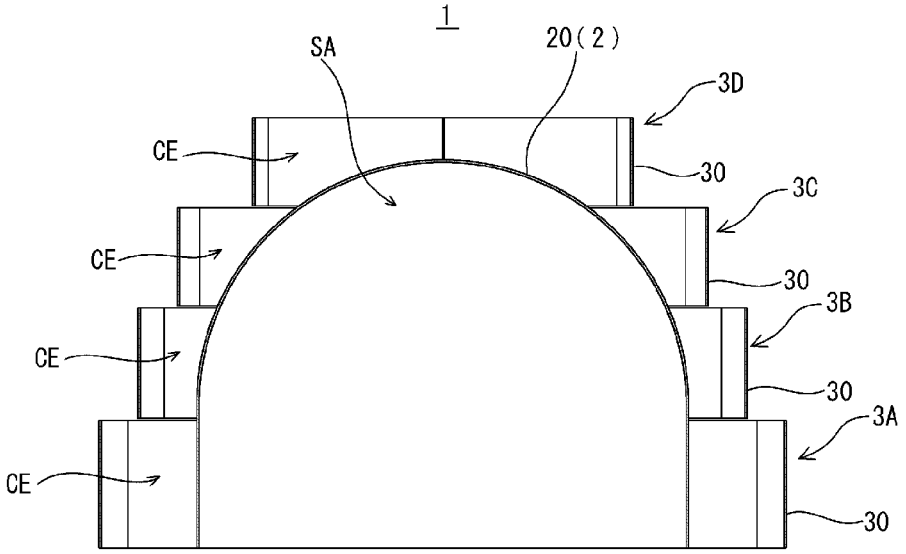
FIG. 3 is a cross-sectional view showing a section A-A of the tent according to the embodiment of the present invention.

Hereinafter, preferred embodiments of the present invention will be described with reference to the drawings. A tent 1 according to the embodiment of the present invention includes, as shown in FIG. 1 to FIG. 4, a tent main body portion 2 and a plurality of (according to the present embodiment, four) snow filling portions 3A, 3B, 3C, and 3D formed in the vertical direction.

The tent main body portion 2 has an internal space forming sheet member 20. The internal space forming sheet member 20 is a sheet member that is able to form an internal space SA separate from the outside as is the case with normal tents. According to the present embodiment shown in FIGS. 1 to 4, the tent main body portion 2 includes only the internal space forming sheet member 20. However, the tent main body portion 2 may include, in addition to the internal space forming sheet member 20, a floor sheet and another supplementary sheet for, for example, protection against cold which are provided integrally with the internal space forming sheet member 20 or for attachment to the internal space forming sheet member 20. A material for the internal space forming sheet member 20 is not limited but may be a waterproof cloth used for normal tents, for example, a waterproof synthetic cloth.

Each of the snow filling portions 3A, 3B, 3C, and 3D is provided around an outer circumferential surface of the internal space forming sheet member 20 so that snow can be filled into the snow filling portion. Furthermore, each of the snow filling portions 3A, 3B, 3C, and 3D has a plurality of cells (small segments) CE arranged adjacently to one another in a circumferential direction and each of which is open at the top and bottom of the cell so that snow can be filled into the cells. Since the cell CE is open at the top and bottom thereof, snow can be fed into the cell CE through the top thereof and discharged from the cell CE through the bottom thereof. FIGS. 1 to 4 show that eight cells CE of the same shape are provided in each of the snow filling portions 3A, 3B, 3C, and 3D so as to lie all along an outer circumference of the internal space forming sheet member 20.

More specifically, the cell CE has an outer circumferential wall sheet member 30 that forms an outer circumferential wall and two partition wall sheet members 31 extending from the outer circumferential wall sheet member 30 (in detail, an inner wall surface of the outer circumferential wall sheet member 30) toward the inside of the tent 1 (the center of the tent 1) and to the internal space forming sheet member 20. Hence, the cell CE has a space enclosed by the outer circumferential wall sheet member 30, the two partition wall sheet members 31, and the internal space forming sheet member 20 and into which snow can be filled. According to the present embodiment, in the uppermost snow filling portion 3D, bottom portions of the partition wall sheet members 31 extend to the internal space forming sheet member 20, and top portions of the partition wall sheet members 31 are joined together at the center of the tent.

Figure 4:
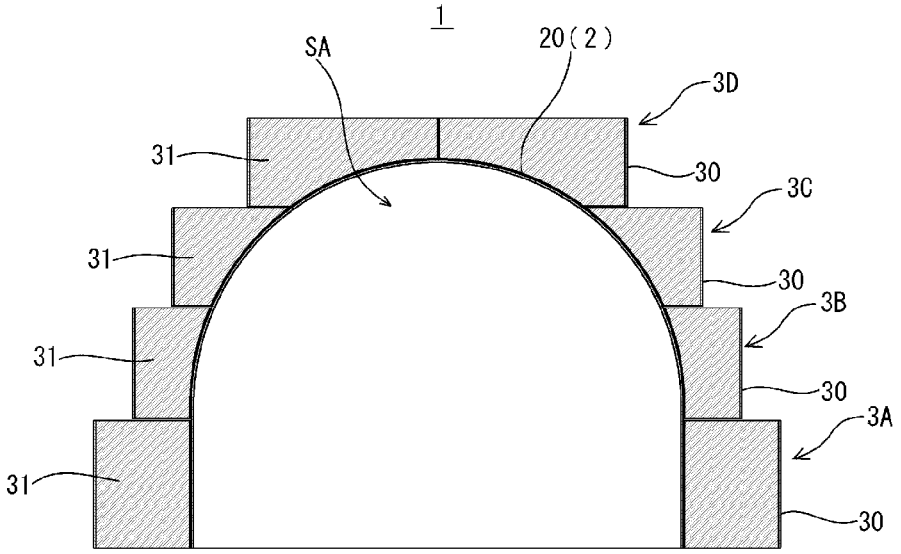
FIG. 4 is a cross-sectional view showing a section B-B of the tent according to the embodiment of the present invention.

Furthermore, for the cells CE adjacent to each other in the vertical direction, the partition wall sheet members 31 of the lower cell CE (for example, the cell CE in the lowermost snow filling portion 3A) are preferably separate from the partition wall sheet members 31 of the upper cell CE (for example, the cell CE in the snow filling portion 3B, located over the snow filling portion 3A) (see particularly FIG. 4). Then, during installation of the tent 1, when snow is filled into the cells CE in order from the lowermost snow filling portion 3A toward the uppermost snow filling portion 3D, the partition wall sheet members 31 of the upper cell CE may be contracted together with the outer circumferential wall sheet member 30 to facilitate an operation of filling snow into the lower cell CE. This also allows the filled snow to be easily removed from any cell through the bottom thereof during disassembly of the tent 1.

Preferably, for the cells CE adjacent to each other in the vertical direction, when the respective outer circumferential wall sheet members 30 are positioned so as to maximize the diameters thereof, the outer circumferential wall sheet member 30 of the lower cell CE is larger than the outer circumferential wall sheet member 30 of the upper cell CE in diameter (the distance from the center of the tent 1 in plan view). For example, the diameter RA of the outer circumferential wall sheet member 30 of the cell CE in the lowermost snow filling portion 3A is set larger than the diameter RB of the outer circumferential wall sheet member 30 of the cell CE in the snow filling portion 3B, located over the snow filling portion 3A. The diameter RB of the outer circumferential wall sheet member 30 of the cell CE in the snow filling portion 3B is set larger than the diameter RC of the outer circumferential wall sheet member 30 of the cell CE in the snow filling portion 3C, located over the snow filling portion 3B. The diameter RC of the outer circumferential wall sheet member 30 of the cell CE in the snow filling portion 3C is set larger than the diameter RD of the outer circumferential wall sheet member 30 of the cell CE in the snow filling portion 3D, located over the snow filling portion 3C (see FIG. 2). Then, the lower cell CE has an area that is not overlapped by the upper cell CE. This allows easy determination of whether the snow in the cell CE in the lower snow filling portion (for example, the lowermost snow filling portion 3A) is sufficient or insufficient. Furthermore, when the snow in the cell is determined to be insufficient, the cell can be easily refilled with snow.

In each of the snow filling portions 3A, 3B, 3C, and 3D, the cells CE adjacent to one another in the circumferential direction normally share the adjacent partition wall sheet members 31. In this case, the outer circumferential wall sheet member 30 forming an outer circumferential wall is continuous between the adjacent cells CE (see FIG. 1 and FIG. 2). Furthermore, a material for the outer circumferential wall sheet member 30 and the partition wall sheet members 31 of the cells CE is not limited but may be a waterproof cloth as is the case with the internal space forming sheet member 20 or a net-like material.

Figure 5:
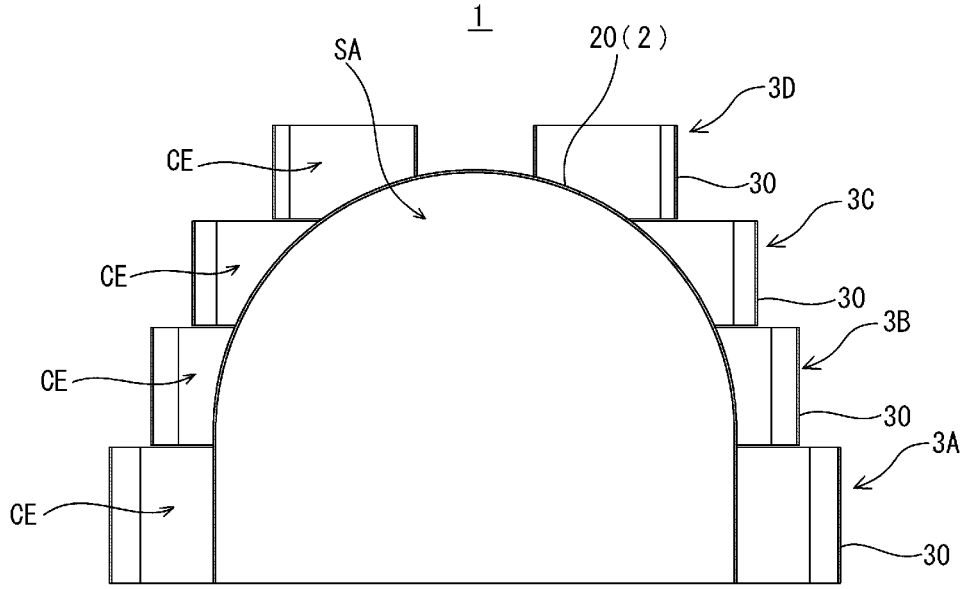
FIG. 5 is a cross-sectional view showing a variation of a peak portion of the tent according to the embodiment of the present invention.

A peak portion of the internal space forming sheet member 20 may be positioned under the uppermost snow filling portion 3D as shown in FIG. 1 to FIG. 4. Alternatively, the internal space forming sheet member 20 may be exposed as shown in FIG. 5.

The size of the tent 1 varies as in the case of normal tents, but the height (vertical length) of the tent may be about 1.5 m. The size of the cell CE may be such that the outer circumferential wall sheet member 30 is about 20 cm to 50 cm in circumferential length and about 20 cm to 50 cm in height (vertical length). And, the height of the outer circumferential wall sheet member 30 may decrease as the snow filling portion shifts from the lowermost snow filling portion 3A toward the upper snow filling portion.

Figure 6:
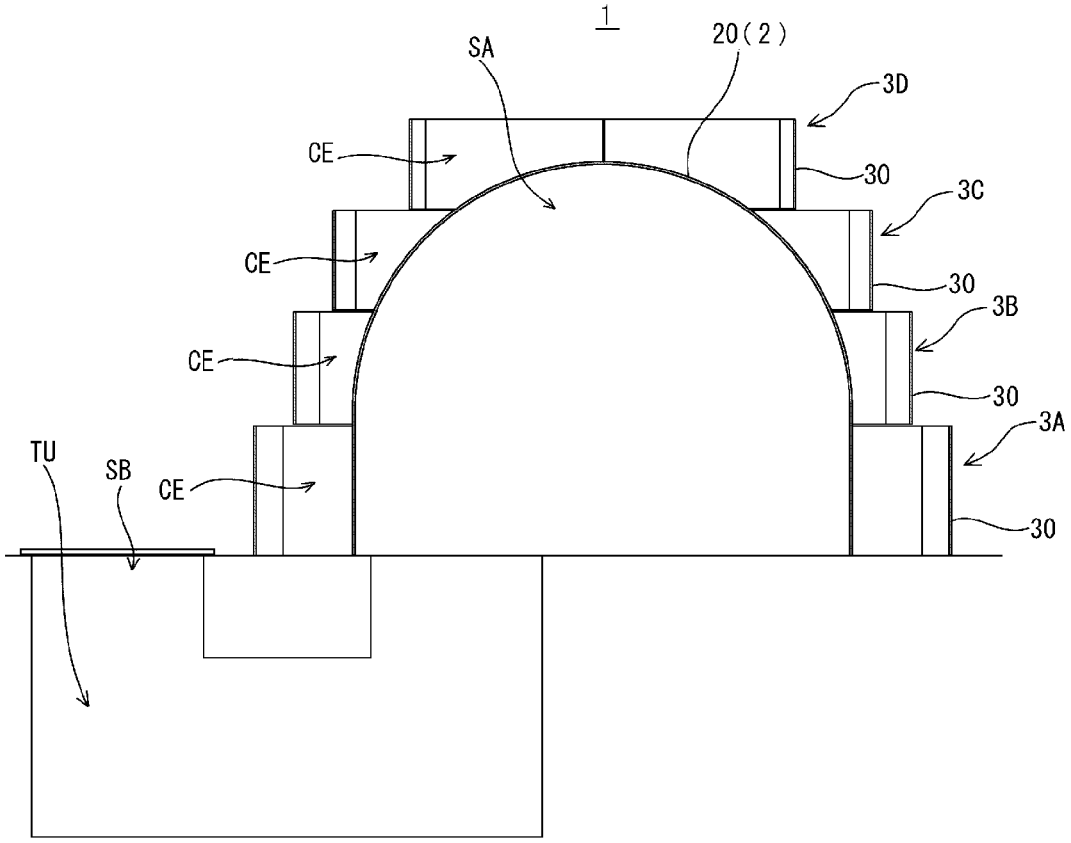
FIG. 6 is a cross-sectional view showing an example of a doorway of the tent according to the embodiment of the present invention.
Figure 7:
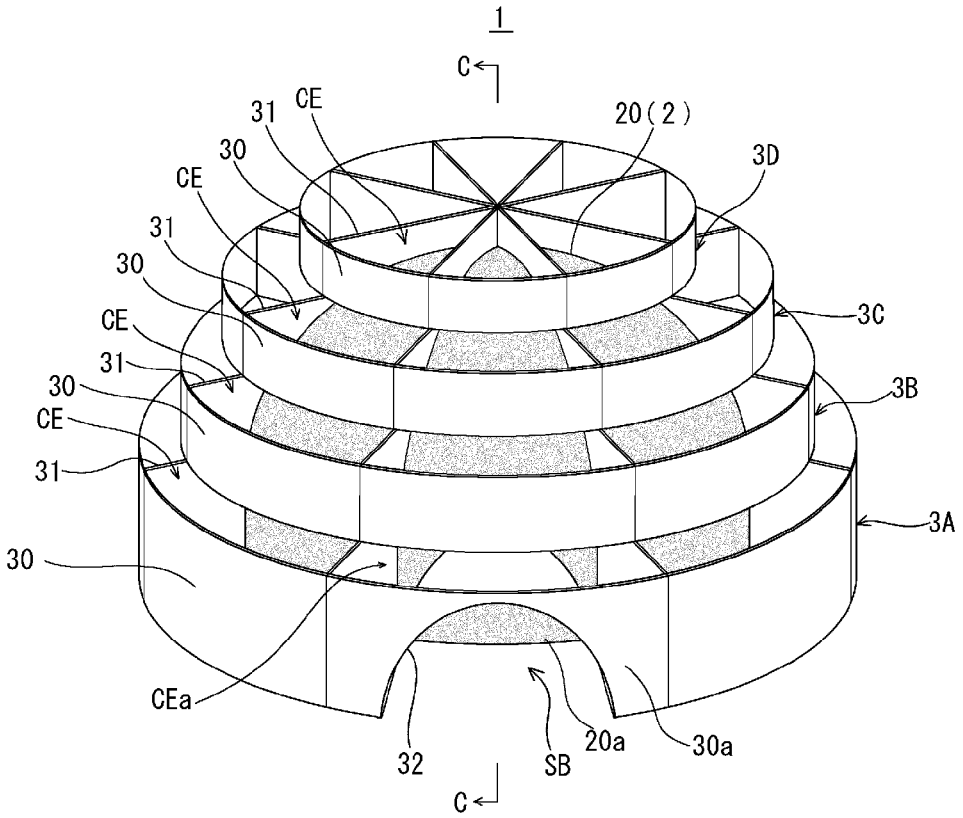
FIG. 7 is a perspective view showing another example of the doorway of the tent according to the embodiment of the present invention.
Figure 8:
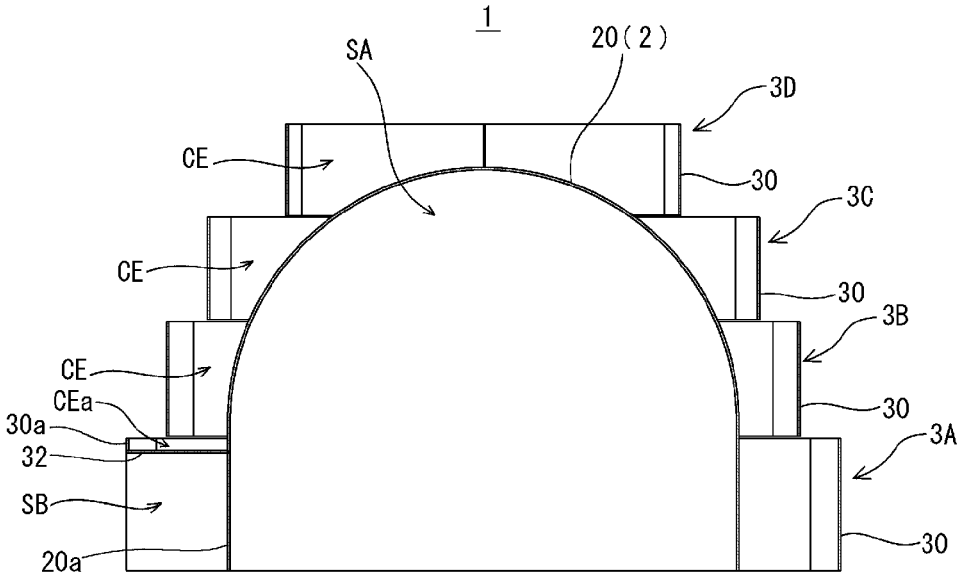
FIG. 8 is a cross-sectional view showing a section C-C in FIG. 7.

A doorway SB of the tent 1 may be provided by methods described below. A first method is, as shown in FIG. 6, to form a tunnel TU under accumulated snow (under the ground) so that the tunnel TU connects the outside to the internal space SA. The doorway SB is configured not to be blocked with falling snow. A second method is to provide the tent 1 itself with the doorway SB. For example, as shown in FIG. 7 and FIG. 8, the doorway SB (in FIG. 7 and FIG. 8, an arch-shaped doorway) is formed to extend from an outer circumferential wall sheet member 30*a* of one cell CEa in the lowermost snow filling portion 3A toward the inside of the tent 1 (the center of the tent 1). A doorway forming sheet member 32 is provided on an upper surface of the doorway SB. A portion 20*a* of the internal space forming sheet member 20 which is located inside the doorway SB is configured to be openable and closable. A portion corresponding to the doorway SB has been removed from the outer circumferential wall sheet member 30*a* of the snow filling portion 3A shown in FIG. 7 and FIG. 8. However, an openable and closable cover may be provided in this portion. As shown in FIG. 7, the cell CEa may be open at the top thereof similarly to the other cells CE. The bottom of the cell CEa may be open in a portion thereof around the doorway forming sheet member 32.

When the tent 1 configured as described above is installed, the tent 1 is put on the base (accumulated snow) and snow is fed into the cells CE in an appropriate order. A procedure for the installation can be as follows. That is, first, snow is fed into the cells CE in the lowest snow filling portion 3A in order (for example, symmetrically with respect to the center of the tent 1). The snow filled in the cells CE in the snow filling portion 3A is pressed, under the snow's own weight, tightly against the base snow and thus prevented from being displaced relative to the base snow. Once snow is filled into all the cells CE in the snow filling portion 3A, the circumferentially adjacent cells CE are pressed against one another via the partition wall sheet members 31 to support one another. Furthermore, the snow in each of the cells CE is subjected to a compression force and hardened. Thus, the snow filling portion 3A as a whole forms a non-collapsible firm contour.

Then, snow is fed into the cells CE in order in the snow filling portion 3B, located over the snow filling portion 3A. The snow filled in the cells CE in the snow filling portion 3B is pressed, under the snow's own weight, tightly against the snow filled in the cells CE in the snow filling portion 3A and thus prevented from being displaced relative to the snow filled in the cells CE in the snow filling portion 3A. Once snow is filled into all the cells CE in the snow filling portion 3B, the circumferentially adjacent cells CE are pressed against one another via the partition wall sheet members 31 to support one another. Furthermore, the snow in each of the cells CE is subjected to a compression force and hardened. Thus, the snow filling portion 3B as a whole forms a non-collapsible firm contour. For the snow filling portion 3A, located under the snow filling portion 3B, the snow filled in the cells CE is further compressed by the snow filled in the cells CE in the snow filling portion 3B and the circumferentially adjacent cells CE further press one another.

Then, snow is fed into the cells CE of the upper snow filling portions 3C and 3D as well. When the peak portion of the internal space forming sheet member 20 is exposed as shown in FIG. 5, a sufficient amount of snow is placed on the exposed peak portion.

When the tent 1 is thus installed, the snow filling portions 3A, 3B, 3C, and 3D with snow filled therein form a firm contour. The tent 1 is thus durable enough to be protected from possible deformation or collapse caused by accumulated snow without the need for a metal frame or the like as a reinforcement. Even when the tent 1 itself is provided with the doorway SB as shown in FIG. 7 and FIG. 8, the tent 1 is sufficiently durable.

The tent 1 can be enhanced in its ability to retain heat inside the tent as explained below. That is, snow filled in the cells CE serves as a heat insulating material that prevents an influence of the temperature of outside air. Furthermore, in the cells CE, snow located near the internal space forming sheet member 20, which forms a tent internal space, is at a temperature very close to 0° C., which is a melting point, due to a mutual phase transition between melting and freezing. Hence, even when the temperature outside the tent 1 is much lower than 0° C., the temperature in the internal space is easily to be maintained over around 0° C., at which people can relatively easily perform activities. When the above-described doorway forming sheet member 32 is used to form the doorway SB, the doorway SB may be filled with snow after a user enters the tent so that the effects of snow can be exerted in the doorway SB as is the case with the other areas.

When the tent 1 is disassembled, any of the cells CE may be selected and the snow filled in this cell CE may be removed through the bottom of the cell CE. Removing snow from each cell CE through the bottom thereof significantly facilitates the operation.

The tent according to the embodiment of the present invention has been described. However, the present invention is not limited to the above-described embodiments but various changes may be made to the design of the embodiment without departing from the scope of the claims. For example, a single snow filling portion may be possibly provided if the tent 1 is relatively small in height (vertical height).

What is claimed is:

1. A tent comprising:

a tent main body portion that has an internal space forming sheet member that is able to form an internal space; and a plurality of snow filling portions formed in a vertical direction; wherein the plurality of snow filling portions are provided around an outer circumferential surface of the internal space forming sheet member and in which snow is allowed to be filled, each of the plurality of snow filling portions includes a plurality of cells that are arranged adjacently to one another in a circumferential direction of each of the plurality of snow filling portions, each of the plurality of cells is open at a top and a bottom of the cell, each of the plurality of cells includes a space enclosed by an outer circumferential wall sheet member forming an outer circumferential wall and two partition wall sheet members extending from the outer circumferential sheet member toward an inside of the tent and the internal space forming sheet member, and when snow is filled into the space of each of the plurality of cells, adjacent ones of the plurality of cells press against each other via the partition wall sheet members to support one another.

2. The tent according to claim 1, wherein, in each of the cells of the adjacent to one another in the vertical direction, the partition wall sheet member of the lower cell is separate from the partition wall sheet member of the upper cell.

3. The tent according to claim 1, wherein, when the cells adjacent to each other in the vertical direction are positioned so as to maximize a diameter of the outer circumferential wall sheet member of each of the cells, the outer circumferential wall sheet member of the lower cell has a larger diameter than the outer circumferential wall sheet member of the upper cell.

4. The tent according to claim 2, wherein, when the cells adjacent to each other in the vertical direction are positioned so as to maximize a diameter of the outer circumferential wall sheet member of each of the cells, the outer circumferential wall sheet member of the lower cell has a larger diameter than the outer circumferential wall sheet member of the upper cell.

* * * * *